US006021294A

United States Patent [19]

Schmidl et al.

[11] Patent Number: 6,021,294

[45] Date of Patent: Feb. 1, 2000

[54] TONER FEED MEANS FOR A DEVELOPER STATION OF A PRINTER OR A PHOTOCOPIER

[75] Inventors: Reinhold Schmidl, Fürstenfeldbruck; Christian Heil, Dorfen, both of Germany

[73] Assignee: Océ Printing Systems GmbH, Poing, Germany

[21] Appl. No.: 09/066,406

[22] PCT Filed: Jun. 27, 1996

[86] PCT No.: PCT/DE96/01144

§ 371 Date: Sep. 4, 1998

§ 102(e) Date: Sep. 4, 1998

[87] PCT Pub. No.: WO97/16769

PCT Pub. Date: May 9, 1997

[30] Foreign Application Priority Data

Oct. 31, 1995 [DE] Germany ..... 195 40 670

[51] Int. Cl.[7] ..... G03G 15/08

[52] U.S. Cl. ..... 399/258; 399/119; 399/259; 399/260

[58] Field of Search ..... 399/119, 120, 399/258, 259, 260, 238, 237, 252, 253, 254, 255

[56] References Cited

U.S. PATENT DOCUMENTS 4,503,625 3/1985 Manzer ..... 355/10
4,945,956 8/1990 Bueyuekgueclue et al. ..... 355/260
5,329,340 7/1994 Fukuchi et al. ..... 355/246
5,521,690 5/1996 Taffler et al. ..... 355/298

FOREIGN PATENT DOCUMENTS

WO 88/02503 9/1987 WIPO .
WO 97/09412 10/1993 WIPO .

*Primary Examiner*—Richard Moses
*Attorney, Agent, or Firm*—Hill & Simpson

[57] ABSTRACT

A pneumatic toner feed mechanism for a developer station of a printer or copier is disclosed. The feed mechanism includes at least two storage containers which are separately allocated to the developer chambers of the developer station. The toner storage containers act as intermediate storage units which are linked to the developer chambers of the developer station by supply ducts. Toner is supplied from bottle-shaped transport containers by a vacuum transport mechanism to the toner storage containers. The transport mechanism includes controllable solenoid valves. The toner level is detected by way of a control mechanism that preferably includes associated capacitive sensors. When a level of toner in a storage container exceeds a predetermined level, the associated valves are opened thereby eliminating the vacuum and associated automatic toner refill. A controller or control means may include a priority control system which preferably refills the toner of the main printing color.

20 Claims, 9 Drawing Sheets

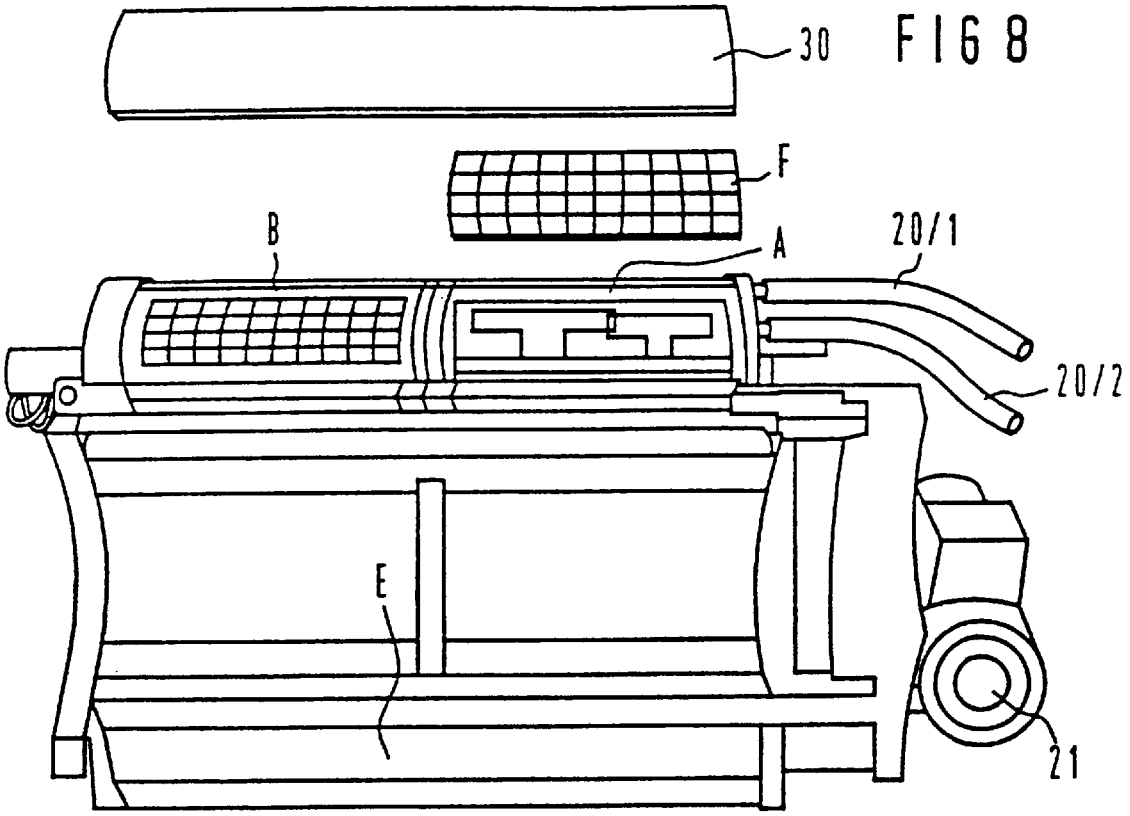
FIG 8
FIG 9
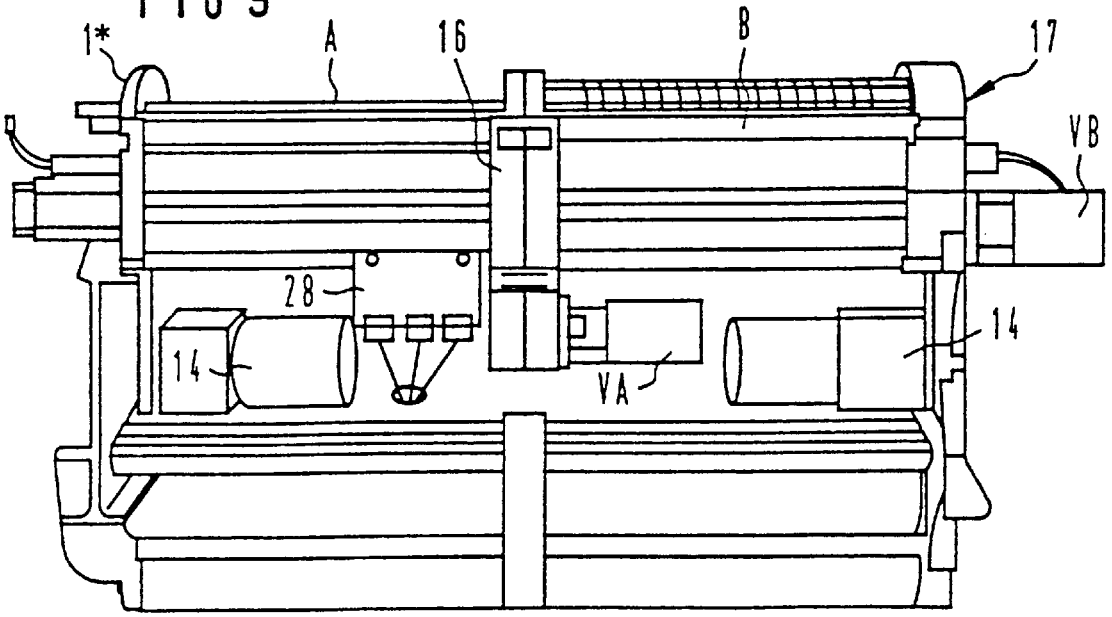

TONER FEED MEANS FOR A DEVELOPER STATION OF A PRINTER OR A PHOTOCOPIER

FIELD OF THE INVENTION

The present invention relates generally to printers and copiers and, more specifically, to toner delivery mechanisms for printers and copiers. Still more specifically, the present invention relates to toner delivery mechanisms for printers and copiers having a plurality of developer chambers for the separate application of toner to different developer regions arranged on an electrographic intermediate carrier.

BACKGROUND OF THE INVENTION

A toner delivery mechanism is fundamentally disclosed by EP-B1 0 332 669. This is thereby a matter of a device for the pneumatic filling of toner from a bottle-shaped transport container into a toner reservoir in which toner is completely suctioned from the transport container with the assistance of underpressure and is thus conveyed into the toner reservoir. The toner reservoir is in communication with a developer station having only a single developer chamber. It contains a mixing means composed of a wire bow and a metering drum of cellular material arranged in the connecting region to the developer station via which toner, which is dosed in printing mode, is supplied to the developer station dependent on its filling level. The toner reservoir itself is divided via a filter into a suction space and a settling space, whereby the settling space is connected to the toner bottle via a hose and the suction space is coupled to an underpressure blower.

Further, WO 94/27193 discloses an electrographic printer means with which it is possible to print a band-shaped recording medium multi-color in simplex and duplex mode. To this end, the printer means contains a plurality of separate developer stations arranged successively or side-by-side that separately ink developer regions on an electrographic intermediate carrier (photoconductor) that are allocated to the developer stations.

In multi-color simplex mode, what is referred to as spot color mode, a print image is first transfer-printed onto the recording medium with a first color, the print image is then fixed, and the recording medium is then returned to the transfer printing station and a print image is printed with a second color and subsequently fixed in a second pass through the fixing station. The transfer printing station is thus traversed with a single recording medium in two recording medium webs arranged parallel next to one another. Corresponding developer regions on the photoconductor are allocated to the recording medium webs. Since photoconductors, whether bands or drums, cannot be arbitrarily wide, it is necessary to arrange the developer regions side-by-side on the photoconductor without significant spacing. The appertaining developer stations must thus also be arranged in close proximity next to one another. To this end, it has already been proposed to employ a single developer station with a plurality of separate developer chambers in which differently colored toner, for example red toner and black toner, is respectively contained.

When toner from a standard toner reservoir with a predetermined capacity is delivered to the developer chambers, then large-volume containers are needed for maintaining the printing operation. These require much space and can therefore not be employed in conjunction with a developer station having a plurality of developer chambers. When smaller containers are employed, this shortens the printing operation.

It has turned out that the great majority of printing is in only a single color, for example black, given multi-color printing with high-speed printers of said species. Only occasionally are individual areas of the print image emphasized with another color or are multi-color graphics or images inserted. Different degrees of consumption of the various types of toner thus occur. The printing time is thus limited by the capacity of the container having the toner that is used most. When, on the other hand, the containers are made of different sizes according to the statistical use, then there is the risk that, given a sudden, longer operation in multi-color, the differently colored toner components needed therefor will be prematurely used and the printing operation will therefore be interrupted.

SUMMARY OF THE INVENTION

It is therefore an object of the invention to fashion a toner delivery mechanism of the species initially cited such that a continuous printer operation is assured.

In the invention, the toner reservoirs are fashioned as true buffer storages to which toner from supply bottles (transport containers) is supplied more or less continuously dependent on their filling level. A pneumatic conveyor means with underpressure is thereby utilized. When the filling level is simultaneously downwardly transgressed at a plurality of toner reservoirs, a priority circuit sees to it that the toner component used most in the ongoing printer operation is replenished first from the corresponding transport container and the printer operation can thus be continued.

The toner is conveyed out of the toner bottles (transport containers) into the toner boxes (toner reservoirs) with underpressure according to the suction principle. In order to assure an adequate suction power given low underpressure, extraction is carried out from only one bottle given a permanently adjacent underpressure at the extraction channel. To this end, the extraction channel is fashioned with suction clock valves such that a multi-path valve arises. It is thus possible to control the filling of the toner boxes merely on the basis of selective actuation of the valves. The toner box with the principal printing color is filled with priority via the priority circuit.

In an embodiment, the present invention provides a toner delivery system for a developer station of a printer or copier that comprises first and second developer chambers. The toner delivery system comprises at least two toner reservoirs including a first toner reservoir and a second toner reservoir. The first toner reservoir being disposed in the first developer chamber; the second toner reservoir being disposed in the second developer chamber. The first toner reservoir includes a first storage area which is in communication with a first toner bottle containing a first toner of a first color. The first storage area is also in communication with a first suction line for drawing first toner from the first toner bottle into the first storage area. The first storage area also accommodates a first level sensor for determining the level of first toner in the first toner area. Analogous to the first toner reservoir, the second toner reservoir also includes a second storage area which is in communication with a second toner bottle which contains a second toner, of a different color than the first toner. The second storage area is also in communication with a second suction line for drawing second toner from the second toner bottle into the second storage area. Like the first storage area, the second storage area also includes a second level sensor for determining the level of second toner in the second storage area. The first suction line has a first valve for isolating the first suction line from the first storage area and, similarly, the second suction line has a second valve for isolating the second suction line from the second storage area. The first and second valves and the first and second level sensors are electrically coupled and controlled by a controller.

In an embodiment, when the first sensor sends a signal to the controller indicating that the level of first toner in the first storage area is low, the controller sends an open signal to the first valve thereby establishing communication between the first suction line and the first storage area and causing first toner to be drawn from the first toner bottle into the first storage area. Similarly, when the second sensor sends a signal to the controller indicating that the level of second toner in the second storage area is low, the controller sends an open signal to the second valve thereby establishing communication between the second suction line and the second storage area and resulting in second toner being communicated from the second toner bottle to the second storage area.

In an embodiment, one of the first and second valves is closed at all times and the controller institutes a priority system whereby when the first sensor sends a signal to the controller indicating that the level of first toner in the first storage area is low, the controller sends an open signal to the first valve thereby establishing communication between the first suction line and the first storage area regardless of whether a signal has been received from the second sensor indicating that the level of second toner is low in the second storage area. Thus, the level of toner in the first storage area takes priority over the level of toner in the second storage area.

In an embodiment, each reservoir comprises a filter disposed between the storage area and a suction space. The suction space being connected to a respective suction line. The filter preventing toner from being communicated from a storage area to a suction space.

In an embodiment, the first and second suction lines are connected to a common vacuum source.

In an embodiment, the suction line supplies a constant vacuum or a constant low pressure supply to the first and second suction spaces.

In an embodiment, the first and second valves are solenoid valves.

In an embodiment, the first and second toner reservoirs each comprise a mixing element for mixing and agitating the toner in the storage areas.

In an embodiment, a partition is disposed between the first and second toner reservoirs and the partition accommodates bearings for the first and second mixing elements.

In an embodiment, conveyors are disposed adjacent to each storage area. The conveyors communicating toner from the respective storage areas to the respective developer chambers.

In an embodiment, the first and second level sensors are capacitive sensors.

Other objects and advantages of the present invention will become apparent from reading the following detailed description and appended claims, and upon reference to the accompanying drawings.

BRIEF DESCRIPTION OF THE DRAWINGS

Embodiments of the invention are shown in the drawings and are described in greater detail below with reference to the drawings, by way of example. In the drawings:

Figure 1:
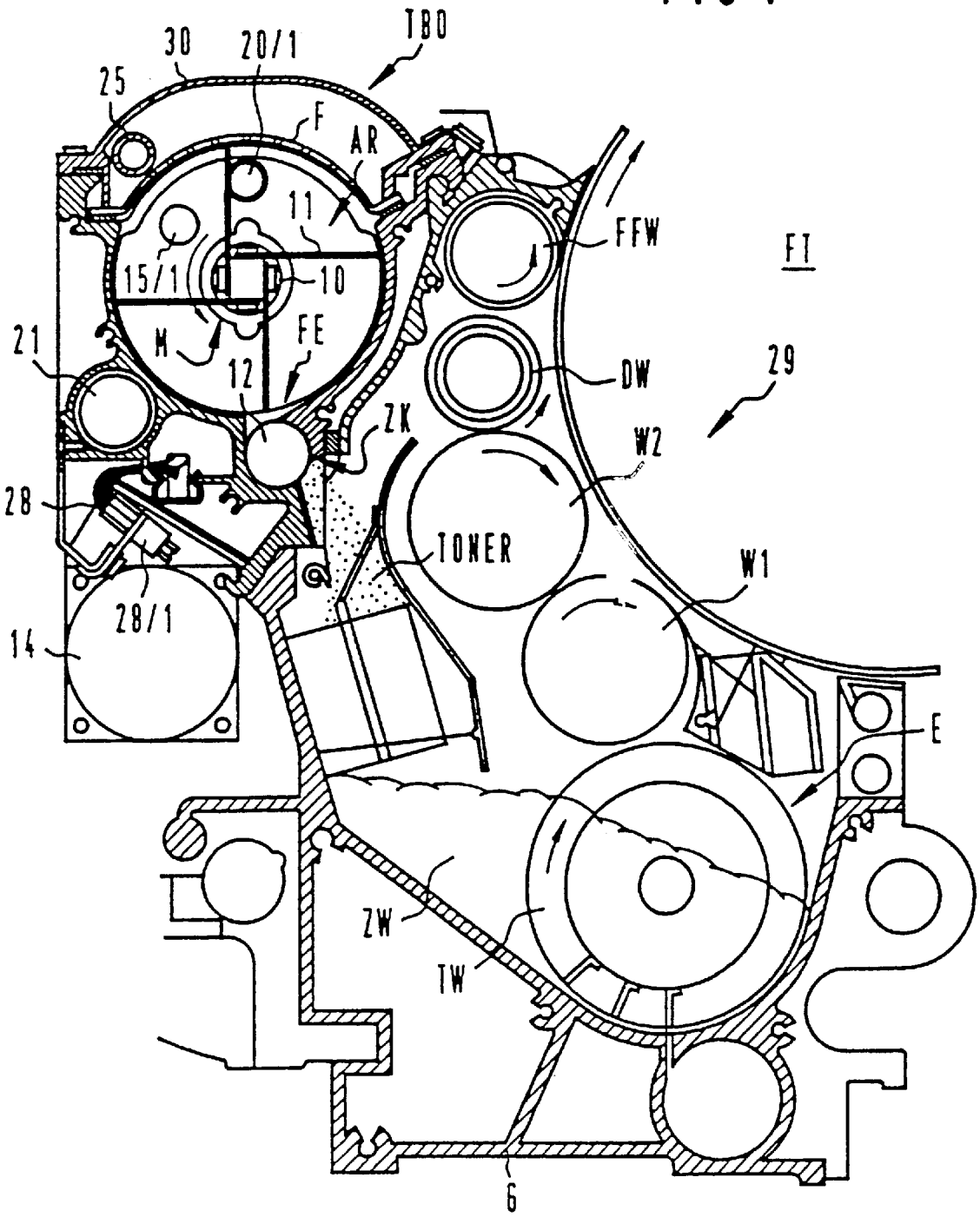
Figure 2:
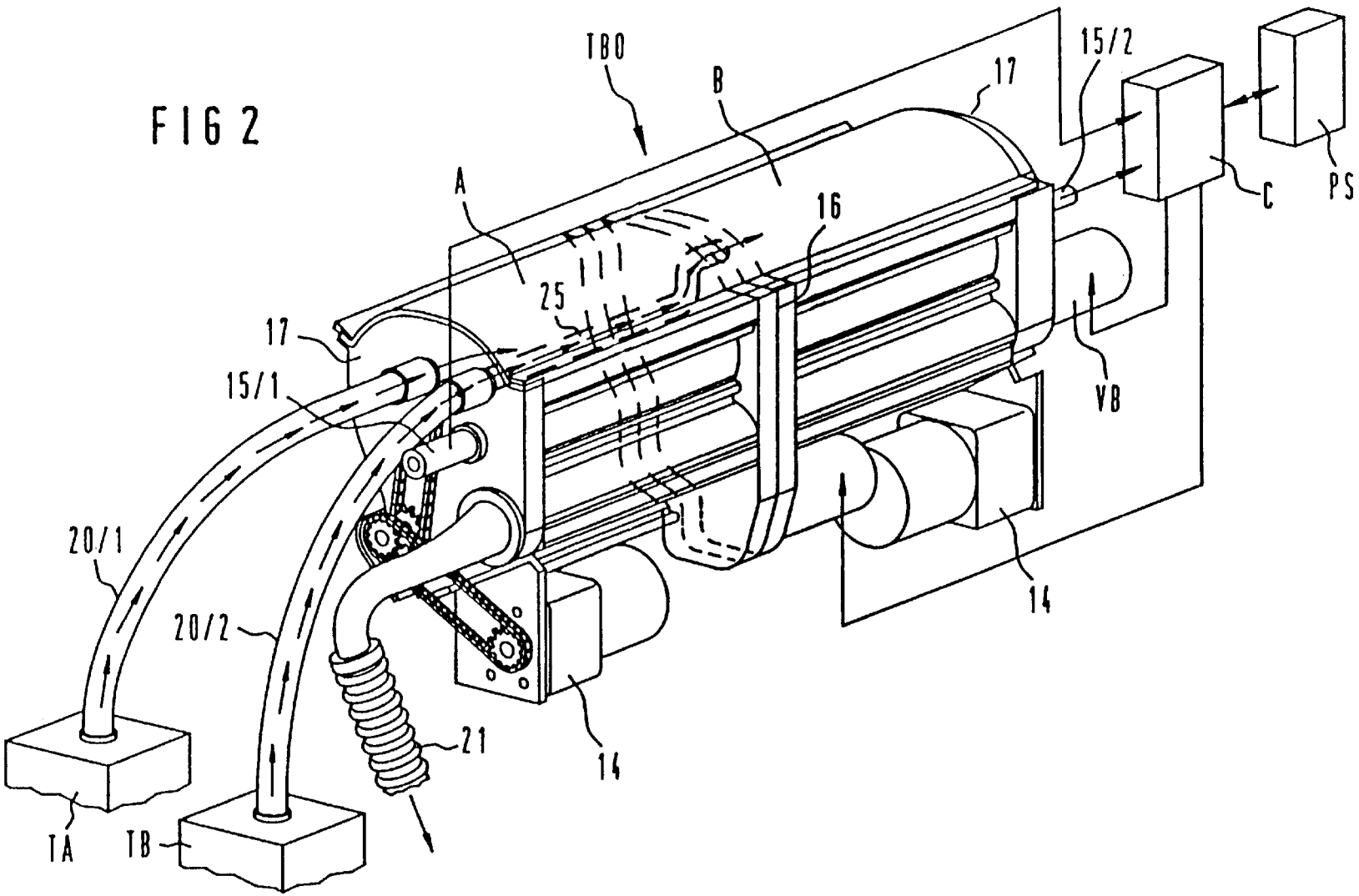
Figure 3:
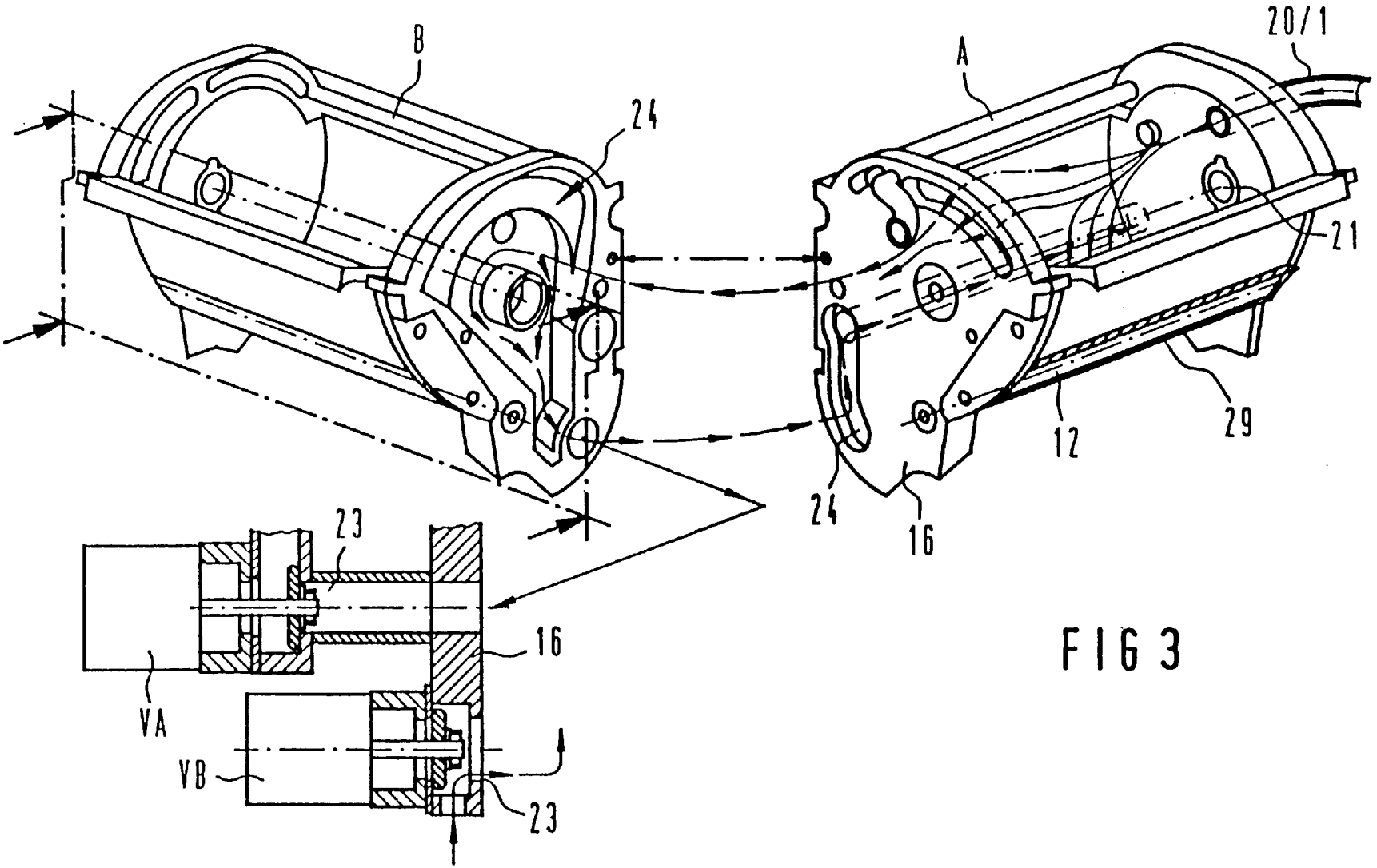
Figure 4:
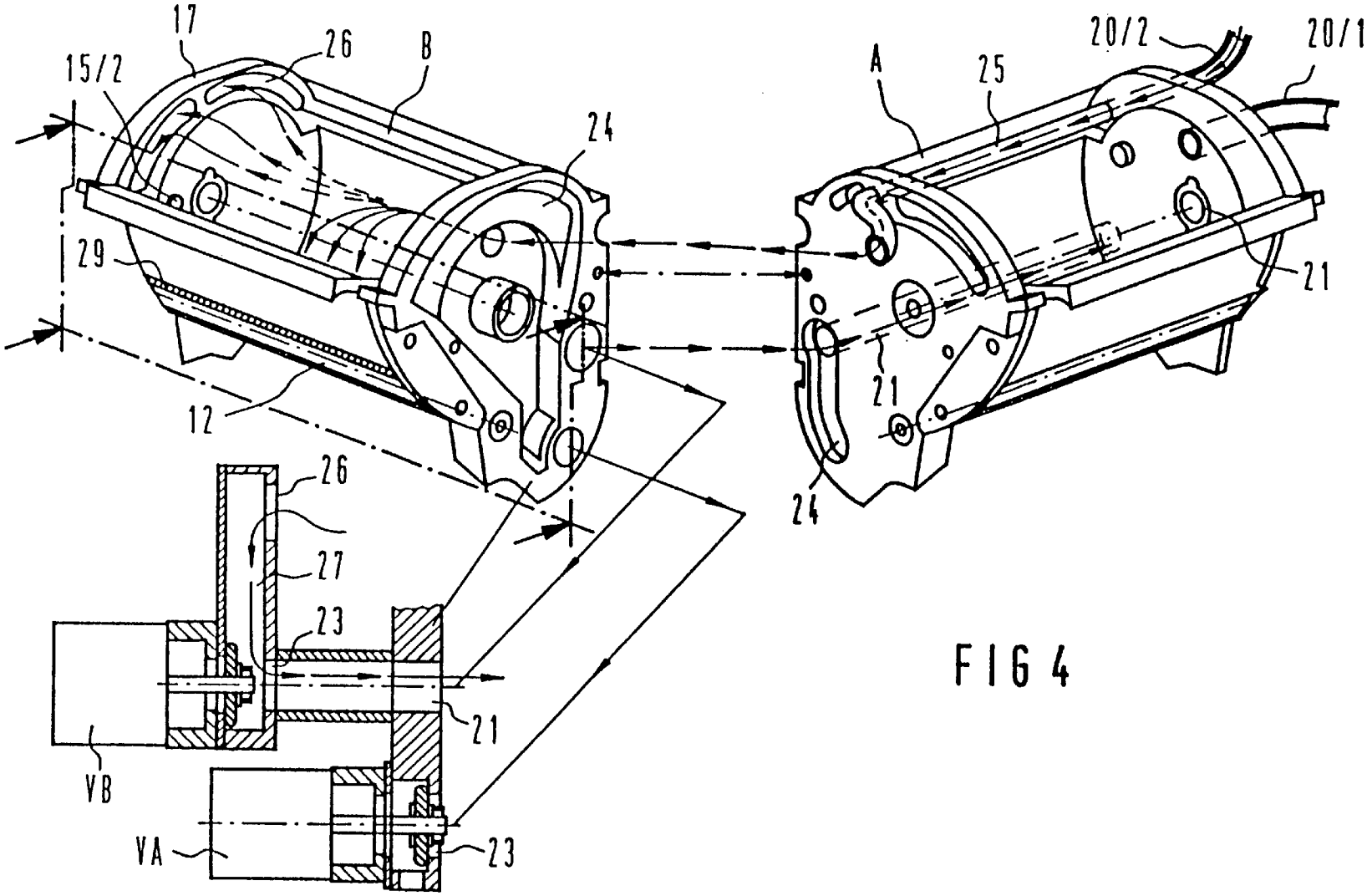
Figure 5:
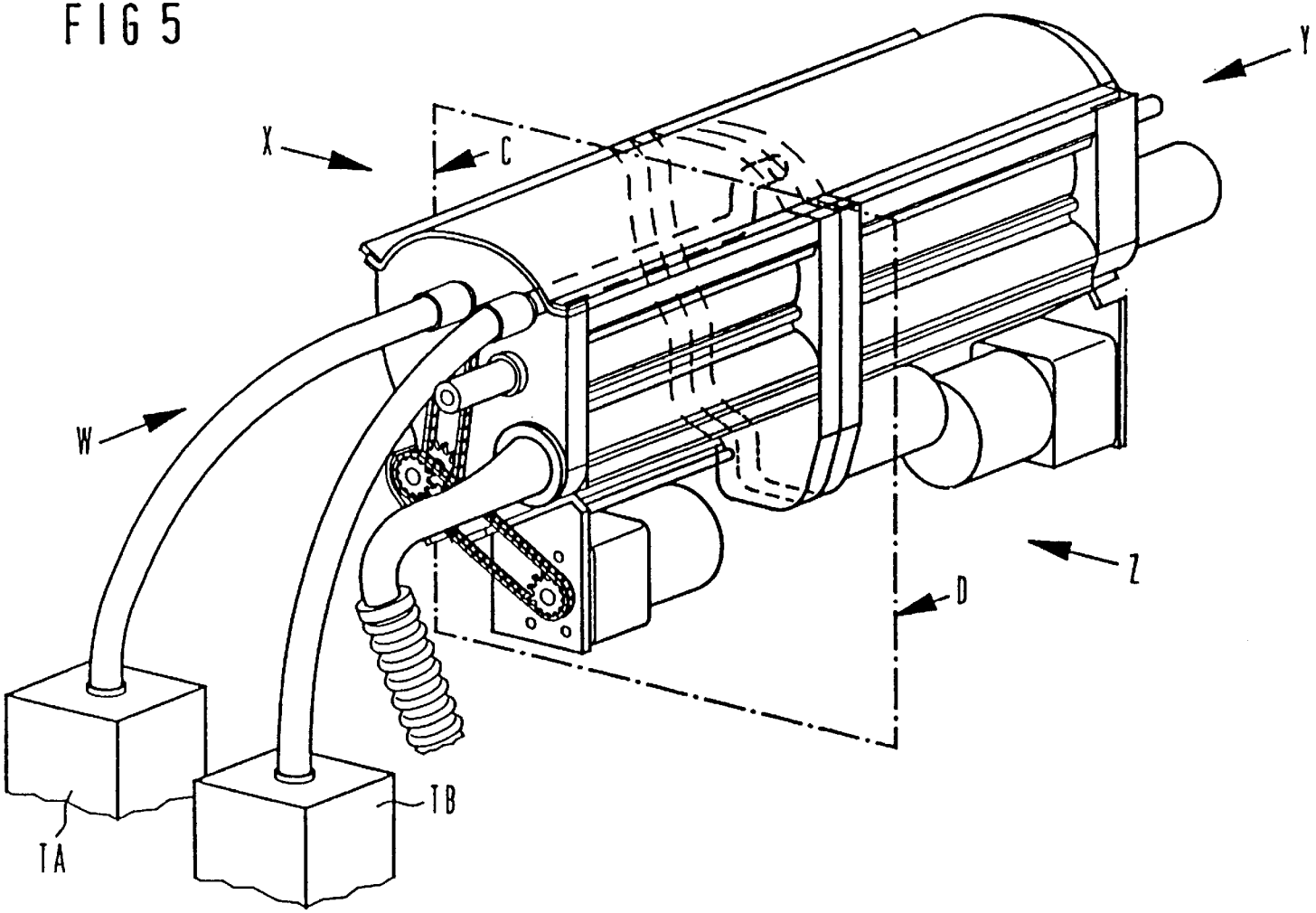
Figure 7:
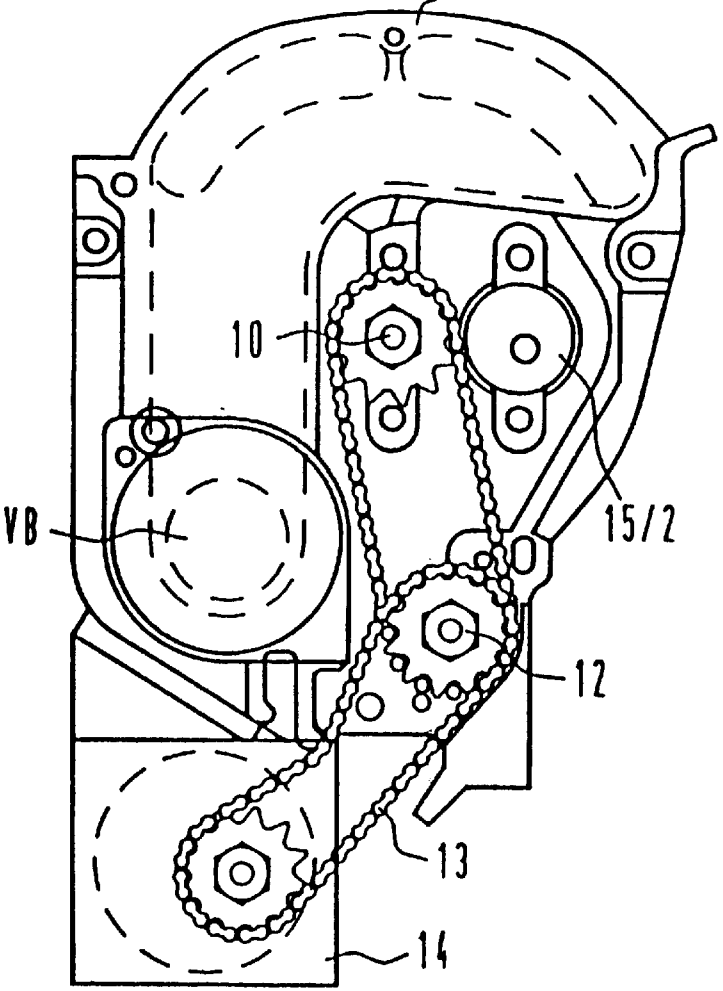
Figure 6:
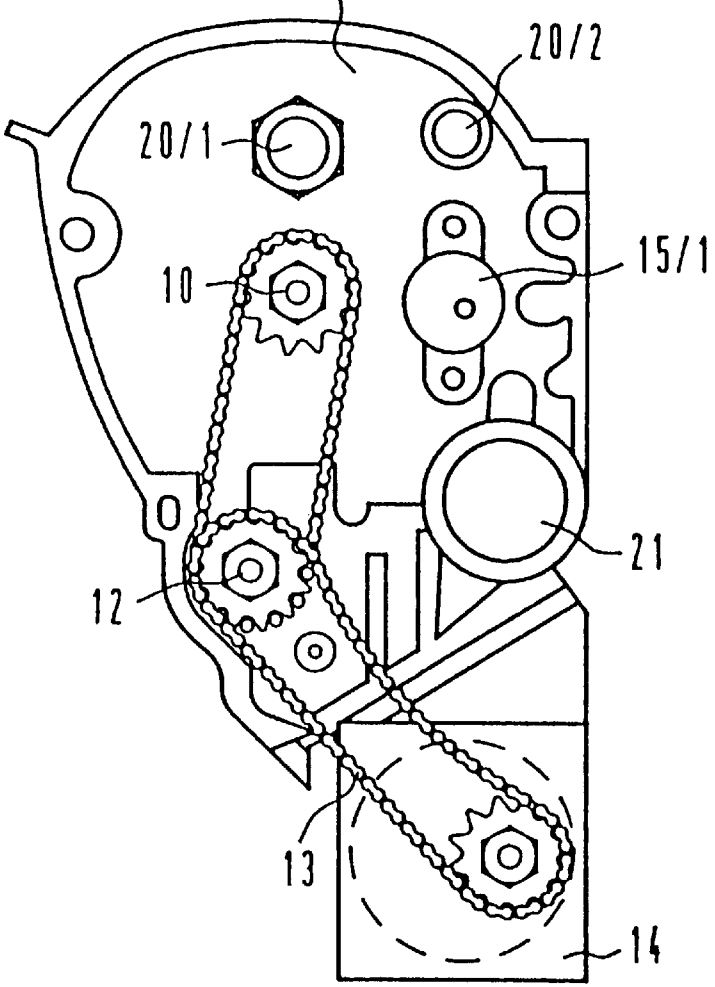
Figure 10:
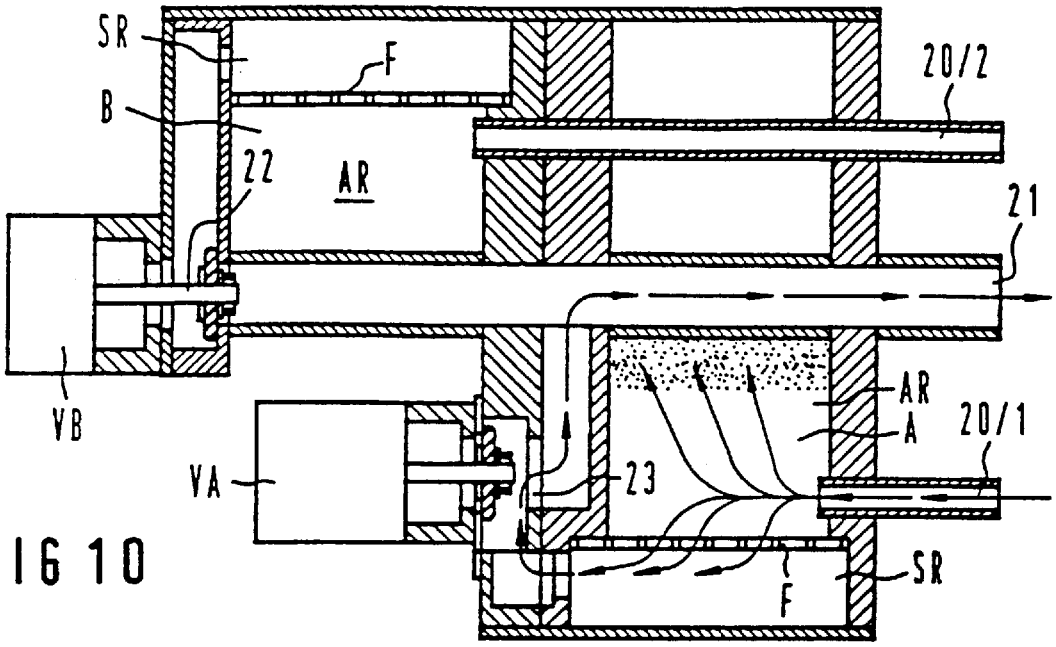
Figure 11:
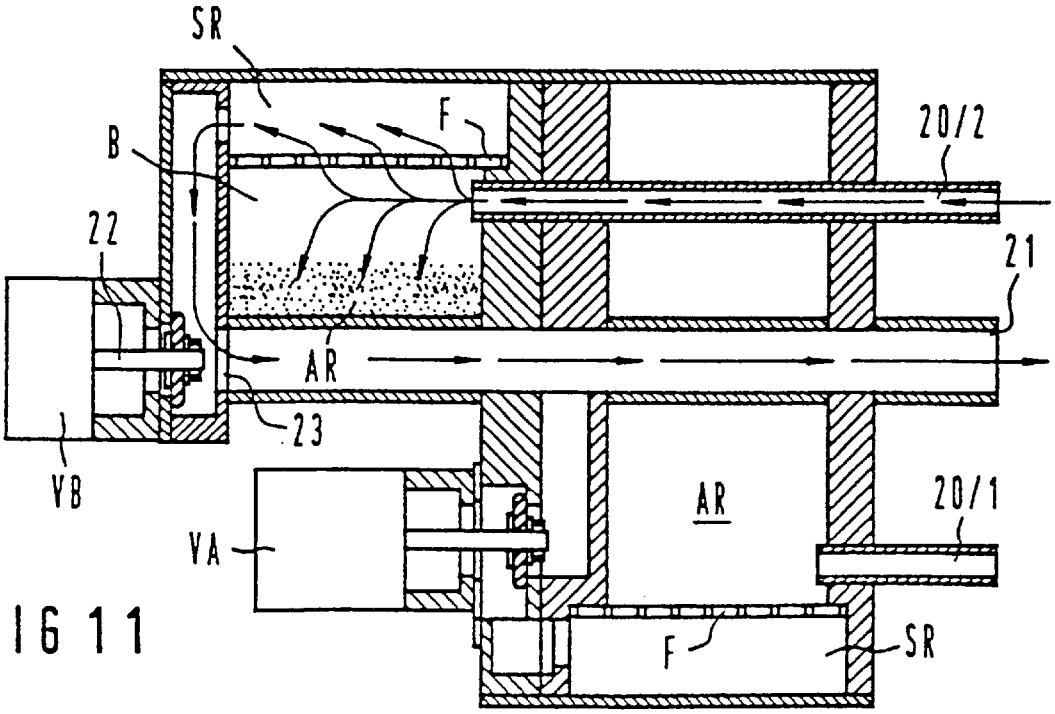
Figure 12:
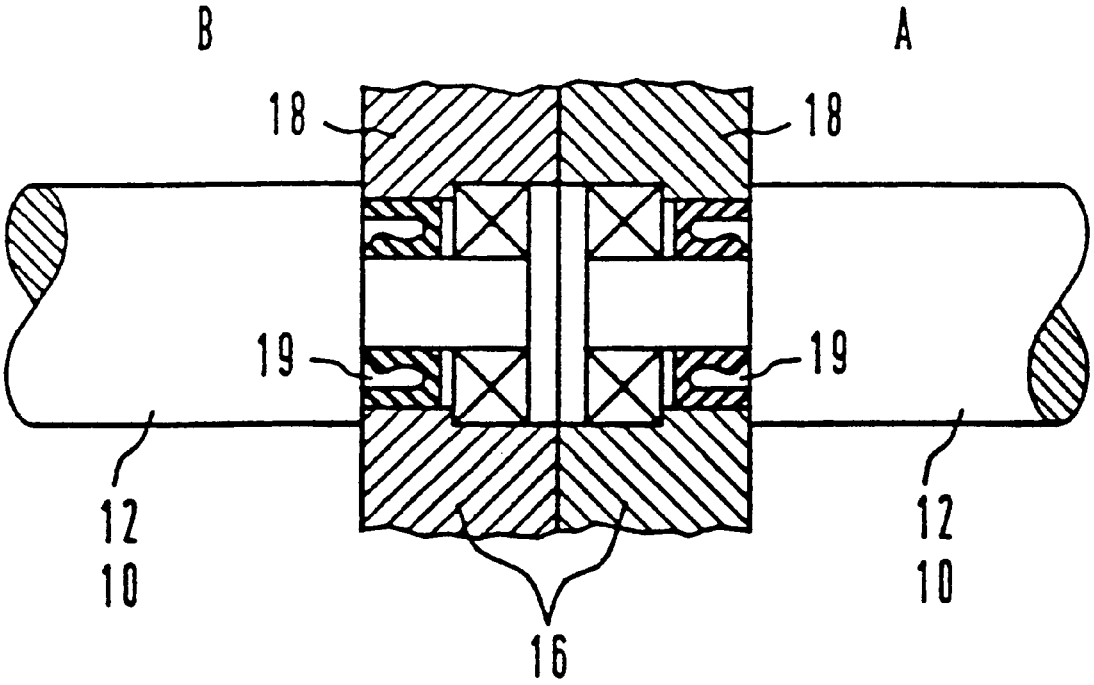

| | |
|---|---|
| FIG. 1 | a schematic sectional view of a developer station with toner reservoirs arranged thereon; |
| FIG. 2 | a schematic illustration of a toner box with two toner reservoirs A and B; |
| FIG. 3 | a schematic illustration of the toner delivery to the toner reservoir A; |
| FIG. 4 | a schematic illustration of the toner delivery to the toner reservoir B; |
| FIG. 5 | a schematic illustration for explaining the position of the illustrations employed; |
| FIG. 6 | a schematic illustration of the view W of FIG. 5; |
| FIG. 7 | a schematic illustration of the view Y of FIG. 5; |
| FIG. 8 | a schematic illustration of the view X of FIG. 5; |
| FIG. 9 | a schematic illustration of the view Z of FIG. 5; |
| FIGS. 10–11 | a schematic illustration for explaining the functions of the closures; and |
| FIG. 12 | a schematic illustration of the sealed bearing in the region of the partition between neighboring transport containers. |

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

An electrophotographic printer device for the multi-color printing of band-shaped recording media in simplex and duplex mode, as disclosed by WO 94/27193, contains a developer station with appertaining toner box as toner buffer storage that is described in greater detail below with reference to the Figures. The developer station is fundamentally composed of two developer stations arranged in a single housing, separated by a thin partition and coupled to one another via the partition that respectively fundamentally have the functional structure disclosed by WO 94/03842. The function of the drums participating in the developing process and their technical characterization is described in WO 94/03842. In this respect, this publication is a constituent part of the present disclosure and is herein incorporated by reference.

The developer station shown in FIG. 1 with appertaining toner box contains a housing G that is arranged in the device and can be pulled out via rails and that has two developer chambers E that are separated via a partition ZW. Two developer drums W1 and W2 composed of a rotatable hollow drum with magnet stator arranged therein as well as of a dosing drum DW of plexiglass with illumination means arranged therein are respectively arranged in the developer chambers E. A transport drum TW seated in the developer sump under the developer drums transports the developer mix to the developer drums W1 and W2. A single carrier capture drum FFW spanning the developer chambers E is arranged outside the developer chambers E in the exit region of the developer station, this carrier capture drum FFW being constructed analogous to the developer drums. All drums except the transport drum are grouped around a photoconductor drum FT according to the course of the developer gap. They rotate in the illustrated arrow directions. They are driven in common via a gearing arranged laterally at the housing G of the developer station.

A toner box TBO (shown in FIGS. 1 and 2) with toner reservoirs A and B respectively allocated to the developer chambers E that are coupled with the developer chambers E via delivery channels ZK is arranged above the developer chambers E. Via a filter F, each toner reservoir A and B is subdivided into a settling space AR and a suction space SR (FIGS. 10,11).

The settling space AR contains a mixing means M in the form of a wire bow 11 seated on a mixer shaft 10 and a conveyor means FE in the form of a dosing drum 12 of cellular material that transports toner to the developer chambers E. Mixer shaft 10 with wire bow 11 seated thereon and the dosing drum 12 are driven via a gearing with chain drive 13 and electric motors 14 (FIGS. 6 and 7) that is laterally arranged at the toner reservoirs A and B. Each toner reservoir A and B thereby has a separate drive.

A capacitative sensor 15/1, 15/2 as filling level sensor for acquiring the filling level of the toner is located in every settling space AR of every toner reservoir A and B.

The toner reservoir A accepting a first toner of a first color and the toner reservoir B accepting a second toner of a second color are mirror-symmetrically constructed; together, they form the toner box TBO. In the regions of their sidewalls 16, the toner reservoirs A, B are positively connected to one another releasable via screws. The drives 13, 14 for the mixing means M and the conveyor means FE are respectively located in the region of their other sidewalls 17. Mixing means M and the conveyor means FE are respectively seated in the sidewalls 16, 17.

The partition of the sidewalls 16 arranged in the boundary region between neighboring toner reservoirs A, B contains the rolling bearings 18 shown in FIG. 12 for the mixing means m and the conveyor means FE, whereby the rolling bearings 18 are sealed from the settling spaces AR of the toner reservoirs A, B by seals 19 (shaft seals). Toner reservoir TB and developer station E are electrically conductively connected to one another but are insulated from the apparatus accepting the housing since toner reservoir TBO and developer station E lie at a bias voltage compared to the photoconductor drum FT during printer operation. All electrical and mechanical component parts of the toner box TBO having a connection to the apparatus must therefore be constructed electrically insulated.

As can be particularly seen from FIG. 2 in combination with the schematic illustrations of FIGS. 10 and 11, each settling space AR of the toner reservoirs A and B is connected via a delivery line 20/1 and 20/2 to a toner transport container TA, TB in the form of a toner bottle. The toner container TA thereby contains toner of a first color, for example black; the toner container TB contains toner of a second color, for example red. Each suction space SR of the toner reservoirs A or B can in turn be coupled via a closure in the form of a suction clock valve VA, VB to an extraction channel 21 to which a means in the form of a blower generating an underpressure is flanged. The valves VA and VB are fashioned as solenoids with a valve piston 22 that, when under current, opens an admission opening 23 to the extraction channel 21 and, when not under current, closes the admission opening 23 via a spring element. It is thus assured that all admission openings 23 are closed given an outage of the current. The valves VA and VB are allocated to the respective toner reservoirs A and B. Underpressure is constantly adjacent at the extraction channel 21 during printer operation. The allocated valve VA or VB is opened so that the corresponding toner from the toner bottles TA or TB can then be supplied to the corresponding settling spaces AR of the toner reservoirs A or B. The respectively other valve VB, VA thereby remains closed. With the assistance of the applied underpressure, the toner from the supply bottles TA, TB thus proceeds into the settling spaces AR and is intercepted there via the filter F. This filter F prevents a passage of the toner into the suction spaces SR. The alternating switching of the valves VA and VB is necessary so that adequate underpressure is always available for transporting the toner. It is thus possible even given slight underpressure to see to a corresponding, reliable transport of the toner from the toner supply bottles TA, TB to the settling spaces AR of the toner reservoirs A and B. Both valves VA and VB can be closed during actual printing operation, so that the underpressure has no negative influence on the toner transport to the developer chambers of the developer station.

For toner delivery of, for example, black toner from the transport container TA into the toner reservoir A of the toner box TBO, the valve VA is placed under current according to the illustration of FIG. 3 and, thus, the admission opening 23 is opened. The valve VB is without current and the appertaining admission opening 23 is thus closed. Toner-air mixture thus proceeds from the toner transport container TA via the delivery line 20/1 into the settling space AR of the toner reservoir A. The toner settles in the settling space AR, and the transport air proceeds via an intermediate channel 24 arranged in the sidewalls 26 and 17 through the admission opening 23 at the valve VA into the extraction channel 21 to the underpressure blower. For the transport of, for example, red toner from the toner transport container TB into the toner reservoir B, the valve VA is closed according to FIG. 4 and the valve VB is opened by being placed under current. Toner-air mixture thus proceeds from the toner transport container TB via the delivery channel 20/2 into the settling space AR of the toner reservoir B via a through channel 25 of the toner reservoir A. The red toner settles in the settling space AR therein. The extraction air proceeds via an opening 26 of the sidewall 17 of the toner reservoir B into a channel 27 to the valve VB with its admission opening 23 and proceeds from the latter to the blower of the means generating the underpressure via the central extraction channel 21 or suction line conducted through the toner reservoirs A and B.

The delivery of the toner from the toner bottles TA and TB into the corresponding toner reservoirs A and B is controlled via a microprocessor-controlled control means C (FIG. 2) that is in turn coupled, on the one hand, to the capacitative sensors 15/1 and 15/2 of the toner reservoirs A and B and, on the other hand, to the valves VA and VB. Via the capacitative sensors 15/1 and 15/2, the controller C thereby acquires the filling level of the toner in the settling spaces AR of the toner reservoirs A and B. When the toner supply drops below a prescribable level, the controller C opens the corresponding valves VA or VB of the toner reservoirs A and B, as a result whereof toner automatically proceeds into the appertaining settling spaces AR. So that it is assured that continued printer operation is assured given a potential, simultaneous downward transgression of the toner level in both toner reservoirs A and B, the main printing color, for example black, of the currently ongoing printing operation is replenished with priority. To this end, the control means C is coupled to a priority control GS. This priority control is in communication with or is a component part of the device controller (not shown here). It acquires the ongoing operating condition of the printer device, i.e. printing with the currently running main color, for example black, namely in that, for example, the data stream of the characters to be printed is acquired in the image memory and evaluated. In the form of a signal, it transmits this operating condition to the control C that then prioritizes the filling of the toner reservoir A (black toner color) or the filling of the toner reservoir B (red toner color) in a standard electronic way, namely in that it opens the appertaining valve VA or VB priority-dependent. The priority can also be designationally input in advance when, for example, printing in black is to be assured.

The inventive toner delivery mechanism for a two-color developer station of a printer or copier device was described above on the basis of a toner box TBO that is composed of two mirror-symmetrically arranged toner reservoirs A and B that are correspondingly allocated to the developer chambers of the developer station. When, for example in full-color operation, a developer station is to be supplied that, for example, contains three or four developer chambers with differently colored toner components, then a corresponding plurality of toner reservoirs can be analogously arranged, these being controlled via corresponding valves. Each printing color can thus be used in equivalent fashion as main color, i.e. full color printing is possible with all colors together. The amount of toner supply is thereby determined only by the size of the external toner supply bottles.

The described, divided toner box of FIG. 2, moreover, can be easily mounted on the developer station E. To this end and according to the illustration of FIGS. 1 and 9, the entire toner box is put in place onto the developer station and is thereby mechanically centered via centering elements. In the region of a plug strip 28, the electrical components of the toner box TBO are thereby automatically connected to a cooperating plug 28/1 of the developer station. A circumferential seal 29 seals the placement region or, respectively, the delivery channels ZK to the developer station. In order to be able to clean or, respectively, replace the filter F in the suction space SR, the toner reservoirs A or B are covered in detachable fashion by a cover 30 secured via screws.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

We claim:

1. A toner delivery system for a developer station of a printer or copier device that comprises a first and second developer chambers, the toner delivery system comprising:

at least two toner reservoirs including a first toner reservoir and a second toner reservoir, the first toner reservoir being disposed in the first developer chamber, the second toner reservoir being disposed in the second developer chamber, the first toner reservoir comprising a first storage area, the first storage area being in communication with a first toner bottle containing a first toner, the first storage area also being in communication with a first suction line for drawing first toner from the first toner bottle into the first storage area, the first storage area also accommodating a first level sensor for determining the level of first toner in the first storage area, the second toner reservoir comprising a second storage area, the second storage area being in communication with a second toner bottle containing a second toner, the second storage area also being in communication with a second suction line for drawing second toner from the second toner bottle into the second storage area, the second storage area also accommodating a second level sensor for determining the level of second toner in the second storage area, the first suction line having a first valve for isolating the first suction line from the first storage area, the second suction line having a second valve for isolating the second suction line from the second storage area, the first and second valves and the first and second level sensors being electrically coupled to a controller.

2. The toner delivery system of claim 1 wherein the first sensor sends a first toner low signal to the controller when the level of the first toner in the first storage area falls below a predetermined level and the controller sending an open signal to the first valve upon receipt of said first toner low signal from the first sensor so that first toner is communicated from the first toner bottle to the first storage area, and the second sensor sends a second toner low signal to the controller when the level of the second toner in the second storage area falls below a predetermined level and the controller sending an open signal to the second valve upon receipt of said second toner low signal from the second sensor so that second toner is communicated from the second toner bottle to the second storage area.

3. The toner delivery system of claim 1 wherein the first toner reservoir further comprises a first suction space and a first filter disposed between the first suction space and the first storage area, the second toner reservoir further comprises a second suction space and a second filter disposed between the second suction space and the second storage area.

4. The toner delivery system of claim 1 wherein the first and second suction lines are connected to a common vacuum source.

5. The toner delivery system of claim 4 wherein the suction line supplies a constant vacuum to the first and second storage areas.

6. The toner deliver system of claim 3 wherein the first filter prevents migration of first toner from the first storage area to the first suction space and the second filter prevents migration of second toner from the second storage area to the second suction space.

7. The toner delivery system of claim 1 wherein one of the first and second valves must is in a closed position at all times.

8. The toner delivery system of claim 2 wherein one of the first and second valves must is in a closed position at all times and, in the event a first toner low signal and a second toner low signal is received by the controller during a common time period, the controller sends an open signal to the first valve resulting in the communication of first toner from the first toner bottle to the first storage area before the controller sends an open signal to the second valve to provide communication of second toner from the second toner bottle to the second storage area.

9. The toner delivery system of claim 1 wherein the first and second valves are solenoid valves.

10. The toner delivery system of claim 1 wherein the first toner reservoir comprises a first mixing element for mixing and agitating the first toner in the first storage area, and the second toner reservoir comprises a second mixing element for mixing and agitating the second toner in the second storage area.

11. The toner delivery system of claim 10 wherein the first and second toner reservoirs are disposed side-by-side with at least one partition disposed therebetween, the partition comprising bearings for the first and second mixing elements.

12. The toner delivery system of claim 1 wherein the first storage area is disposed adjacent to a first conveyor for communicating first toner from the first storage area to one of the developer chambers, and the second storage area is disposed adjacent to a second conveyor for communicating second toner from the second storage area to another of the developer chambers.

13. The toner delivery system of claim 12 wherein the first and second toner reservoirs are disposed side-by-side with at least one partition disposed therebetween, the partition comprising bearings for the first and second conveyors.

14. The toner delivery system of claim 1 wherein the first toner is of a first color and the second toner is of a second different color.

15. The toner delivery system of claim 1 wherein the first and second toner reservoirs are disposed side-by-side with a central partition disposed therebetween, the first and second toner reservoirs being detachably connected to one another.

16. The toner delivery system of claim 1 wherein the first level sensor is a capacitive sensor and the second sensor is a capacitive sensor.

17. A toner delivery system for a developer station of a printer or copier device that comprises a plurality of developer chambers at least a first developing chamber and a second developing chamber for separate application of toner to a plurality of developer regions arranged on an electrographic intermediate carrier, the toner delivery system comprising:

at least two toner reservoirs including a first toner reservoir and a second toner reservoir, the first toner reservoir being disposed in a first developer chamber, the second toner reservoir being disposed in a second developer chamber, the first toner reservoir comprising a first storage area and a first suction space with a first filter disposed therebetween, the first storage area being in communication with a first toner bottle containing a first toner, the first storage area accommodating a first level sensor for determining the level of first toner in the first storage area, the second toner reservoir comprising a second storage area and a second suction space with a second filter disposed therebetween, the second storage area being in communication with a second toner bottle containing a second toner, the second storage area accommodating a second level sensor for determining the level of second toner in the second storage area, the first storage area in fluid communication with a suction line with a first valve disposed therebetween, the second storage area in fluid communication with the suction line with a second valve disposed therebetween, the first and second valves and the first and second level sensors being electrically coupled to a controller, the first sensor sending a first toner low signal to the controller when the level of the first toner in the first storage area falls below a predetermined level and the controller sending an open signal to the first valve upon receipt of said first toner low signal from the first sensor so that first toner is communicated from the first toner bottle to the first toner storage area, the second sensor sending a second toner low signal to the controller when the level of the second toner in the second storage area falls below a predetermined level and the controller sending an open signal to the second valve upon receipt of said second toner low signal from the second sensor so that second toner is communicated from the second toner bottle to the second storage area.

18. The toner delivery system of claim 17 wherein one of the first and second valves must be in a closed position at all times and, in the event a first toner low signal and a second toner low signal is received by the controller during a common time period, the controller sends an open signal to the first valve resulting in the communication of first toner from the first toner bottle to the first storage area before the controller sends an open signal to the second valve to provide communication of second toner from the second toner bottle to the second storage area.

19. The toner delivery system of claim 17 wherein the first toner reservoir comprises a first mixing element for mixing and agitating the first toner in the first storage area, the second toner reservoir comprises a second mixing element for mixing and agitating the second toner in the second storage area, the first and second toner reservoirs being disposed side-by-side with at least one partition disposed therebetween, the partition comprising bearings for the first and second mixing elements.

20. The toner delivery system of claim 17 wherein the first storage area is disposed adjacent to a first conveyor for communicating first toner from the first storage area to one of the developer chambers, the second storage area is disposed adjacent to a second conveyor for communicating second toner from the second storage area to another of the developer chambers, the first and second toner reservoirs are disposed side-by-side with at least one partition disposed therebetween, the partition comprising bearings for the first and second conveyors.

* * * * *